US008105224B2

(12) United States Patent
Dropsy et al.

(10) Patent No.: US 8,105,224 B2
(45) Date of Patent: Jan. 31, 2012

(54) EQUIPMENT FOR MAKING A DUAL COMPONENT PACK TRAY

(76) Inventors: Marie-Claude Dropsy, Royan (FR); Philippe Dropsy, Royan (FR)

( * ) Notice: Subject to any disclaimer, the term of this patent is extended or adjusted under 35 U.S.C. 154(b) by 359 days.

(21) Appl. No.: 12/447,390

(22) PCT Filed: Oct. 26, 2007

(86) PCT No.: PCT/FR2007/052254

§ 371 (c)(1),
(2), (4) Date: Apr. 27, 2009

(87) PCT Pub. No.: WO2008/053114

PCT Pub. Date: May 8, 2008

(65) Prior Publication Data

US 2010/0069210 A1 Mar. 18, 2010

(30) Foreign Application Priority Data

Oct. 27, 2006 (FR) ..... 06 09472

(51) Int. Cl.
*B31B 1/62* (2006.01)

(52) U.S. Cl. ..... 493/128; 493/93; 493/100; 493/134; 493/150

(58) Field of Classification Search ..... 493/93, 493/95, 98, 100, 111, 128, 134, 150; 53/175
See application file for complete search history.

(56) References Cited

U.S. PATENT DOCUMENTS

| | | | | |
|---|---|---|---|---|
| 4,226,170 | A * | 10/1980 | Christensson | 493/95 |
| 4,687,462 | A * | 8/1987 | Rewitzer | 493/100 |
| 4,832,675 | A * | 5/1989 | Stearns et al. | 493/128 |

FOREIGN PATENT DOCUMENTS

| | | |
|---|---|---|
| FR | 2826937 | 1/2003 |
| FR | 2883223 | 9/2006 |
| WO | 2006097662 | 9/2006 |

OTHER PUBLICATIONS

International search report in corresponding PCT/FR2007/052254.

* cited by examiner

*Primary Examiner* — Hemant M Desai
(74) *Attorney, Agent, or Firm* — Young & Thompson

(57) ABSTRACT

Apparatus for making a pack tray includes a body with a strip of side walls, the body including an outer envelope lined on the inside with an added sealed plastic film. The apparatus includes at least one station provided with elements for applying glue on a portion at least of the inner surface of the side wall strip of the outer envelope, also called gluing area, before placing a plastic film. The gluing pads include at least one block of a porous material that can, one the one hand, be filled with glue by loading members through a diffusion phenomenon, and that can deposit glue by contact optionally combined with a compression force on the gluing area. The pad is mounted on a bearing structure via members for handling it between expanded positions in which the pad contacts the gluing area for applying glue thereon and a folded position in which the gluing pad is remote from the outer envelope of the pack tray.

17 Claims, 2 Drawing Sheets

EQUIPMENT FOR MAKING A DUAL COMPONENT PACK TRAY

CROSS-REFERENCE TO RELATED APPLICATIONS

The instant Application claims benefit of priority to International Application No. PCT/FR2007/052254 filed Oct. 26, 2007 and French Application No. 0609472 filed Oct. 27, 2006.

STATEMENT REGARDING FEDERALLY SPONSORED RESEARCH OR DEVELOPMENT

None.

THE NAMES OF THE PARTIES TO A JOINT RESEARCH AGREEMENT

None.

INCORPORATION-BY-REFERENCE OF MATERIAL SUBMITTED ON A COMPACT DISC

None.

BACKGROUND OF THE INVENTION (1) Field of the Invention

The present invention relates to the general field of packaging; more particularly, it relates to a new equipment structure for making a sealed pack tray formed by the assembling of an outer envelope, made of a relatively rigid material, such as cardboard, and an inner lining made of a thermoformed plastic film sealing the pack tray.

(2) Description of Related Art

In the dual component pack trays known to date, described for example in FR-2 826 937, the outer envelope is made integral with the inner plastic film through a gluing process, the glue being sprayed or projected on the inner face of said outer envelope.

Also, some glues of interest for assembling pack trays whose content is intended to be later cooked or reheated are difficult to apply through such a spraying method; that is the case, for example, for certain acrylic-type glues.

Moreover, a spraying process is not always clean and efficient. This glue application method generally results in soiling the surroundings, which is harmful to industrial production of the pack trays, in particular in the field of food-processing.

BRIEF SUMMARY OF THE INVENTION

To remedy these drawbacks, the applicants have developed a novel equipment described in FR-2 883 223.

Essentially, this equipment includes a gluing station comprising the following structure elements:

- at least one pad-type gluing member, capable of being filled with glue over at least one portion of its surface and capable of coming into contact with the area(s) to be glued of the pack tray outer envelope, for applying glue thereon, and
- means for filling said gluing member with glue, comprising a planar glue-supplying surface, such filling means being configured so as to apply glue over said surface portion of said gluing member.

In this invention, the gluing member consists in a body made of elastic material, capable of being deformed between a glue collecting configuration in which its surface(s) to be filled with glue extend, in projection, in a same plane, and a gluing configuration in which the surface(s) filled with glue are capable of coming into contact with the area(s) to be glued of the outer envelope.

Such particular structure makes it possible to apply glue in a simple way inside the outer envelope of the pack tray, just before placing the inner plastic cover. But, because of its structure and the different movements it is led to do, the gluing pad can sometimes not suitably detach from the outer envelope after the glue has been put on. Moreover, the glue collecting area of the pad is not always located strictly at the same place because the pad deformation is not well controlled; hence, the area of the cardboard outer envelope where glue is applied presents some variations.

Therefore, the applicants have developed a new equipment for making a dual component pack tray, allowing a fast, precise and repeatable application of glue over one or more defined areas of the outer envelope, in a simple and effective way.

This new equipment is of the type described in FR-2 883 223, i.e.—it is adapted for making a pack tray the body of which, consisting of a bottom part connected to a strip of side walls, comprises an outer envelope made of rigid or semi-rigid material, for example cardboard, lined on the inside with an added sealed plastic film, said plastic film being made integral with said envelope through gluing one or more areas to form the area(s) of connection between the two materials, and—it notably comprises a gluing station including at least one pad-type gluing member mounted on a supporting structure, said gluing member being capable of coming into contact with at least one portion of the inner face of at least one of the side walls of said outer envelope, to form said gluing area.

According to the invention, the gluing pad(s) consist in at least one porous material block capable, on the one hand, of being filled with glue through a diffusion phenomenon within said porous material block, and on the other hand, of applying glue through contact, optionally in combination with a compression force, over said gluing area; moreover, said gluing pad(s) are mounted on the supporting structure thereof via means for their expanding or folding operation between, on the one hand, an expanded position in which said pad is in contact with said gluing area so as to apply glue thereon, and on the other hand, a folded position in which said gluing pad is remote from the outer envelope of said pack tray, notably to allow the entrance and exit movements of said outer envelops into and from said gluing station.

Such equipment has notably for advantage to ensure that glue is always applied precisely at the same place on the inner face of the cardboard outer envelope.

According to a particularly advantageous characteristic, the means for extending and folding operation of the pad(s) make the latter move between two limit positions, namely an inwardly folded position and an outwardly extended position.

According to another characteristic, for making a pack tray having a strip of four side walls, the gluing means comprise at least two gluing pads, each capable of applying glue over at least one portion of two of said side walls.

According to a first particular embodiment, the gluing pad(s) are each mounted on a support via a cylinder for the operation of said associated gluing pad(s) between the above-mentioned expended and folded positions.

According to a second advantageous embodiment, the gluing-pad supporting structure is in the form of a vertical or substantially vertical central supporting axis, on which is articulated at least one extendable arm connected to operating means, and the free end of which carries a gluing pad, said operating means extending and folding said extendable arm(s) with respect to said central supporting axis. In this case, the extendable arm(s) cooperate with a slide that can be operated along the height of the central supporting axis, being displaced by means of a control cylinder; the translation movements of said slide operating said extendable arm(s) in the extension and folding directions.

Advantageously, the latter gluing station structure can have a pantograph-type general configuration, i.e.:

- the extendable arm(s) are articulated at the lower end of the central supporting axis, the slide cooperating with said extendable arm(s) through an intermediate arm having one end articulated on said slide and the other end articulated on said associated extendable arm, at a point located between the two ends thereof, or
- the extendable arm(s) are articulated at one of their ends on the supporting axis slide, one or more intermediate operating arms being articulated, on the one hand, at the lower end of the central supporting axis, and on the other hand, on one of the extendable arms, at an articulation point located between the two ends thereof.

According to another feature, the glue feeding means comprise at least one tank connected to a circuit for supplying glue to at least one of the porous material blocks, said supplying circuit comprising flow control means, such as notably a pump, a solenoid valve and/or a manual valve.

BRIEF DESCRIPTION OF THE SEVERAL VIEWS OF THE DRAWINGS

The invention will be further illustrated, without being in any way limited, by the following description of several particular embodiments given only by way of example and shown in the attached drawings, in which.

DETAILED DESCRIPTION OF THE INVENTION

FIGS. 1A to 1D show some steps for making a dual component pack tray in an equipment according to the invention, namely gluing the inner face of the outer envelope and placing the sealed plastic film. As described below, the gluing method that is implemented consists in applying glue over one or more areas of the outer-envelope inner face by a dabbing process, so as to simply apply the glue through contact.

Figure 1A:
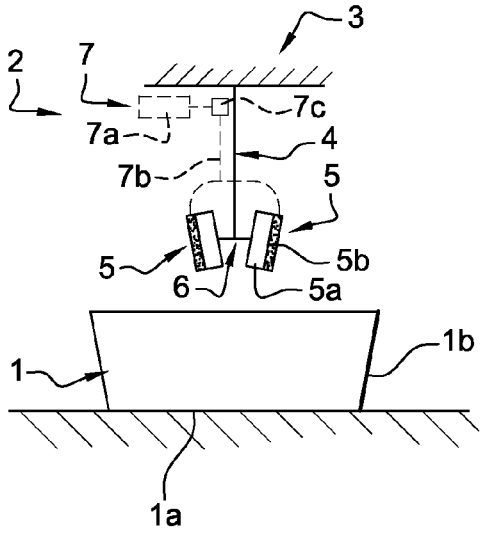
FIGS. 1A to 1D (FIG. 1) show, in a general and schematic manner, the main steps implemented at a gluing station according to the invention for making dual component pack trays.

FIG. 1A shows the pack-tray outer envelope 1 suitable positioned at a gluing station 2 according to the invention.

The outer envelope 1 is made of an appropriate material, preferably cardboard (of the compact or corrugated type, advantageously recyclable cardboard). In this case, it consists in a bottom wall 1*a* connected to a strip of peripheral side walls 1*b* slightly flaring outwardly so as to form a generally pyramid-frustum-shaped unit.

This envelope 1 is constructed through creation of a volume from a cardboard blank suitably cut and grooved; it can also be obtained from moulded paper pulp, for example.

According to another embodiment, the outer envelope 1 can be made of cellular plastic material; it can also be made from association of different materials, for example a veneer/cardboard mix.

Generally, the nature and thickness of the material from which the outer envelope 1 is made are chosen according to the size of the pack tray and the purpose thereof.

The gluing station 2 comprises a frame 3, movable in the vertical direction, carrying a central supporting structure 4 on which are mounted herein two gluing members 5, via operation means 6.

Said operating means 6 control the associated gluing members 5, between an outwardly extended position and an inwardly folded position. In this case, in FIG. 1A, the pads 5 are shown in folded position and grouped on the side of the central supporting structure 4.

The gluing members 5 are pads, capable of coming into contact with a portion of the inner face of the outer envelope 1 (and in particular a portion of the side walls 1*b*), so as to each form a gluing area.

In this case, the gluing pads 5 comprise a supporting body 5*a*, carried by the above-mentioned operating means 6, provided with at least one porous material block 5*b* (for example, a cellular synthetic foam) capable of being filled with glue through a diffusion phenomenon.

The glue comes from filling means 7, herein comprising a glue tank 7*a* connected to a supplying circuit 7*b* (for example in the form of flexible pipes) comprising classical flow control means 7*c* (for example a pump, a solenoid valve and/or a manual valve).

Figure 1B:
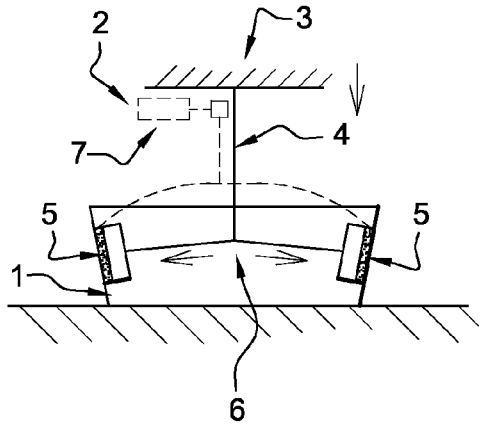
Figure 1C:
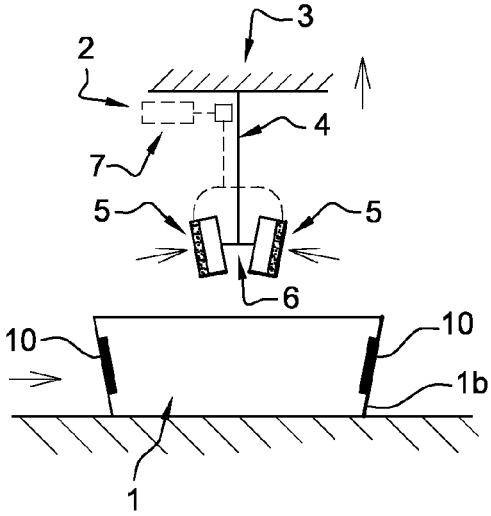
Figure 1D:
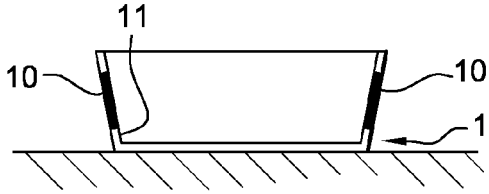

The steps of FIGS. 1B to 1D show in detail the gluing of the outer envelope 1 through the use of said gluing station 2 (FIGS. 1B and 1C), and assembling of the inner thermoplastic film (FIG. 1D).

As shown in FIG. 1B, the frame 3 of the gluing station 2 is operated downward, toward the underlying outer envelope 1.

Simultaneously or alternatively, when the frame 3 reaches its low limit position, the operating means 6 are driven in outward extension so that their gluing pads 5 (glue-impregnated foam) come into contact with the opposite side walls 1*b* of the outer envelope 1 to apply glue through contact (optionally in combination with a compression phenomenon).

Once the glue applied, the pads 5 are extracted from the outer envelope 1 so as to come back to their initial position (FIG. 1C). To that end, the pads 5 are driven in reverse movements with respect to those performed during gluing (described above in relation with FIGS. 1A and 1B).

More precisely, the operating means 6 are driven inwardly so that the associated gluing pads 5 come into a folded limit position, remote from the side walls 1*b* of the pack-tray outer envelope 1; moreover, the frame 3 is driven in a vertical upward movement, so as to extract the pads 5 from the bulk of the outer envelope 1.

As shown in FIG. 1C, the glue is applied in the form of lines or strips 10.

The shape, surface and position of these glue strips or lines 10 are function of the desired linking structure between the outer envelope 1 and the added inner plastic film. The porous blocks 5*b* are configured accordingly.

The thus-glued outer envelope 1 is taken out from the gluing station 2, to be transported to the next station where the inner thermoplastic film 11 is added, as schematically shown in FIG. 1D.

The plastic film 11 can be directly thermoformed within the outer envelope 1. For example, it is placed by means of a thermoforming die (classic in the field in question).

Alternatively, the plastic film 11 can be previously thermoformed, and added into the outer envelope 1.

The porous blocks 5*b* of the pads 5 are permanently refilled with glue by the filling means 7, so as to permit the successive gluing steps. The tank 7*a* feeds the system by gravity or by means of a pump; the flow rate of the glue is adjusted according to the needs, by acting, if need be, on the diameter and the opening time of the feeding valve, or else on the pressure supplied by the feeding pump.

Thus, the final product obtained consists in a pack tray comprising an outer envelope 1 lined on the inside with a thermoformed plastic film 11; these two materials are assembled and fastened together by the gluing areas 10.

Preferably, the gluing areas are continuous or discontinuous lines or strips, formed only at the upper edges of the four side walls of the pyramid-frustum-shaped strip of the pack tray, so as to permit an easy separation between the outer envelope 1 and its inner lining 11 after the use, in the purpose of recycling the materials.

So as to optimize the efficiency, the equipment comprises means for simultaneously transporting a plurality of outer envelops 1, juxtaposed relative to each other; it also comprises a gluing station 2 whose frame 3 is equipped with a suitable number of supporting units 4/pads 5 for applying glue simultaneously over said juxtaposed outer envelops 1.

Generally, such glue dabbing makes it possible to apply the glue in only one step, in precise, fast and reliable manner, over defined areas of the outer envelope 1.

Moreover, the corresponding equipment makes it possible to glue the outer envelope 1 of the pack tray with many types of glue that are normally difficult to apply by spraying, for example acrylic glues. The use of such acrylic glues is particularly advantageous regarding their heat resistance characteristics, which notably, in a food industry application, makes it possible to cook or reheat food stuffs directly in their packing tray.

The number of pads and the shape of their active face are function of the configuration of the strip of side walls 1*b* of the outer envelope 1. For making a pack tray including a strip of four side walls, the gluing means advantageously comprise two gluing pads 5, each capable of applying glue over two opposite ones of the side walls, or four pads capable of gluing said four side walls.

In combination with the step of gluing the side walls 1*b*, or separately, it can be contemplated to glue all or part of the bottom wall 1*a* of the outer envelope 1.

To this end, the supporting structure 4 can be equipped with an additional and auxiliary pad capable of coming into contact with said bottom wall 1*a*, so as to apply glue thereon, also by dabbing.

FIGS. 2 to 4 show particular structures of the gluing station 2, similar to that described above in relation with FIG. 1, pertaining to complete equipments for making dual component pack trays (to simplify the description, the filling means 7, similar to those described above, are not shown).

Figure 2A:
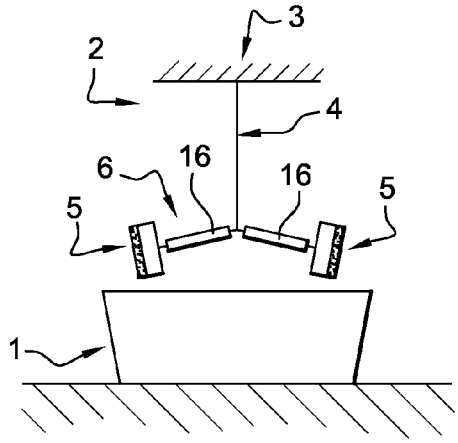
FIGS. 2A and 2B (FIG. 2) show, also in a schematic manner, the main steps for gluing an outer envelope at a gluing station the pads of which are carried by cylinder-type operating means.
Figure 2B:
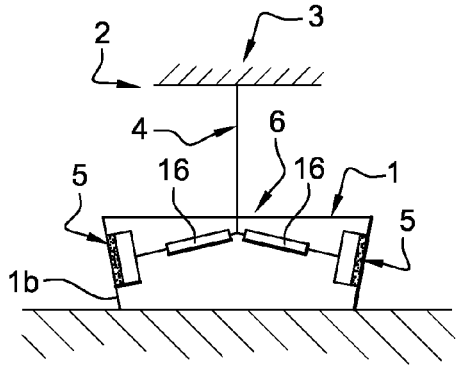

Thus, FIGS. 2A and 2B show a first possible embodiment of the gluing station 2, the gluing pads 5 of which are each mounted on the supporting structure 4 via operating means 6 in the form of pneumatic cylinders 16.

Said cylinders 16 operate the pads 5 in horizontal or substantially horizontal direction, between two limit positions:

- a position in which they are folded inwardly on the side of the supporting structure 4 (FIG. 2A), and
- a position in which the pads 5 are extended outwardly and come into contact with the opposite side walls 1*b* of the outer envelope 1 (after downward operation of the frame 3) so as to apply glue through contact, optionally in combination with a compression phenomenon (FIG. 2B). The displacement of the cylinders 16 is advantageously perpendicular to the plane of the walls 1*b*.

Figure 3A:
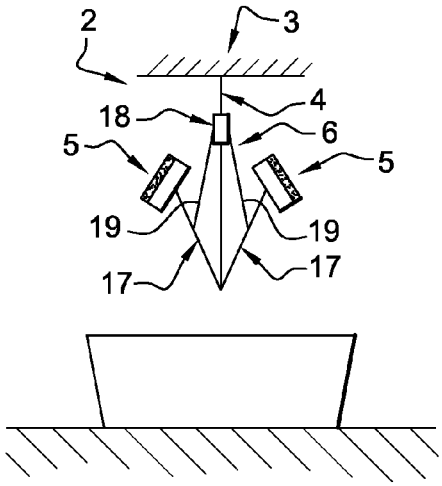
FIGS. 3A and 3B (FIG. 3) show, also in a schematic manner, the main steps implemented at a gluing station the pads of which are carried by pantograph-type operating means.
Figure 3B:
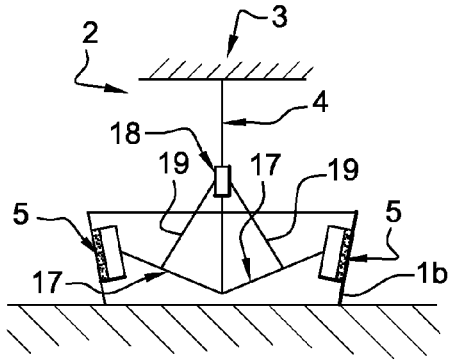
Figure 4A:
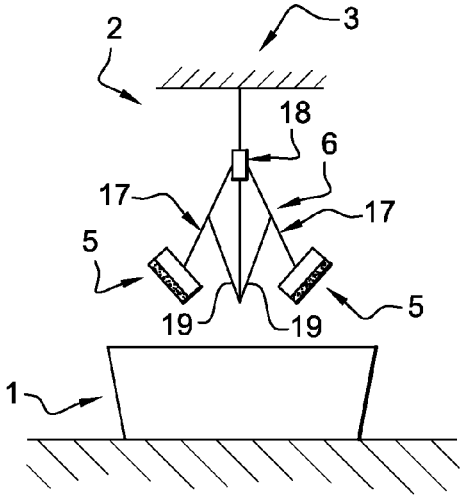
FIGS. 4A and 4B (FIG. 4) show, also in a schematic manner, a gluing station the pads of which are also carried by pantograph-type structure, which is an alternative to that shown in FIG. 3.
Figure 4B:
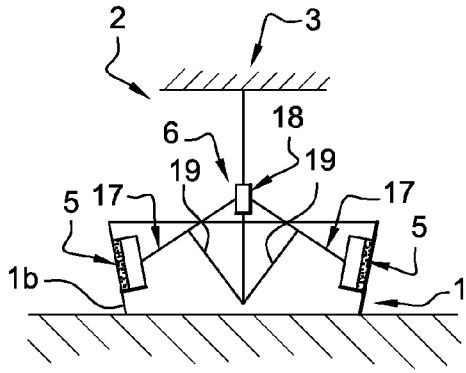

FIGS. 3 (FIGS. 3A and 3B) and 4 (FIGS. 4A and 4B) show (in a schematic manner) pads 5 mounted on their supporting structure 4 via pantograph-type operating means 6.

In this case, the supporting structure 4 has the general form of a vertical or substantially vertical central supporting axis, on which are articulated extendable arms 17 the free end of which carries one of the gluing pads 5.

Said arms 17 are operable with respect to the central supporting axis 4, between folded (FIGS. 3A and 4A) and extended (FIGS. 3B and 4B) limit positions.

To that end, a slide 18 is adapted to move along the height of the central supporting axis 4, and the translation movement thereof operate said extendable arms 17 in the extension and folding directions; a pneumatic cylinder (not shown) is implanted so as to operate the slide 18.

More precisely, in the case of the gluing station 2 according to FIG. 3, the extendable arms 17 are articulated at the lower end of the central supporting axis 4, each around an horizontal or substantially horizontal axis (not shown), herein parallel to the opposite side wall 1*b* intended to be glued.

The slide 18 cooperates with each of the arms 17 by means of an intermediate arm 19, having one end articulated on said slide 18 and the other end articulated on the associated extendable arm 17, at a point located between the two ends thereof.

Alternatively, as shown in FIG. 4, one end of the extendable arms 17 is articulated on the slide 18.

As for the intermediate arms 19, they are each articulated, on the one hand, at the lower end of the central supporting axis 4, and on the other hand, on one of the extendable arms 17, at an articulation point located between the two ends.

In practice, as can be seen in FIGS. 3B and 4B, the operation of the slide 18 toward the lower end of the central supporting axis 4 (remotely from the frame 3), by means of the control cylinder (not shown), causes the opening of the extendable arms 17 and the displacement of the pads 5 to their outwardly extended position. The frame 3 being operated downward, the porous block 5*b* of the pads 5 then comes into contact with the opposite side wall 5*b* of the outer envelope 1, so as to apply glue thereon.

Conversely, as shown in FIGS. 3A and 4A, the moving upward of the slide 18 (i.e., in this case, toward the associated frame 3) moves the extendable arms 17 to the inwardly folded position, that also corresponds to a folded position of the different gluing pads 5; in this position, the frame 3 having been lifted, the outer envelops 1 can be placed on the gluing station 2, or be extracted from this station, without being hindered by the gluing means 4, 5, 6.

The choice of either one of the solutions described in reference with FIGS. 2, 3 and 4 will notably be function of the size and shape of the pack tray, the available room and the number of gluing taps used.

The invention claimed is:

1. An equipment for making a pack tray comprising:

- a body consisting of a bottom part connected to a strip of side walls, said body consisting of an outer envelope (1)

made of rigid or semi-rigid material, for example cardboard, lined on the inside with an added sealed plastic film (11), said equipment comprises at least one station (2) equipped with means for applying glue over at least one portion of the inner surface of the strip of side walls (1*b*) of said outer envelope (1), called "gluing area" (10), before placing said plastic film (11), said means for gluing comprising:

at least two pad-type gluing members (5) mounted on a supporting structure (4);

each of said at least two gluing members consisting of at least one porous material block (5*b*); and means for filling said porous material blocks with glue through a diffusion phenomenon;

wherein said pad type gluing members (5) are mounted on said supporting structure (4) via means for operating (6) said gluing members in expanding or folding position, wherein in the expanding position said gluing members are in contact with said gluing area to apply glue through contact and/or with compression force, and in the folding position said gluing members (5) are remote from the outer envelope (1) of said pack tray to allow the entrance and exit movements of said outer envelops (1) into and from said gluing station.

2. The equipment according to claim 1, wherein the means (6) for extending and folding operation of said gluing members (5) make said gluing members (5) move between two limit positions, namely an inwardly folded position and an outwardly extended position.

3. The equipment according to claim 2, for making a pack tray having a strip of four side walls, wherein the gluing means comprise the at least two gluing pad members (5), each capable of applying glue over at least one portion of two of said side walls (1*b*).

4. The equipment according to claim 2, wherein said gluing members (5) are each mounted on a supporting structure (4) via a cylinder (16) for the operation of said associated gluing pad members (5) between the expended and folded positions.

5. The equipment according to claim 2, wherein the gluing-pad supporting structure (4) is in the general form of a vertical or substantially vertical central supporting axis, on which is articulated at least one extendable arm (17) connected to operating means (6), and the free end of which carries a gluing pad member (5), said operating means (6) extending and folding said extendable arm(s) (17) with respect to said central supporting axis (4).

6. The equipment according to claim 2, wherein the glue feeding means (7) comprise at least one tank (7*a*) connected to a circuit (7*b*) for supplying glue to at least one of the porous material blocks (5*b*), said supplying circuit (7*b*) comprising flow control means (7*c*).

7. The equipment according to claim 1, for making a pack tray having a strip of four side walls, wherein the gluing means comprise the at least two gluing pad members (5), each capable of applying glue over at least one portion of two of said side walls (1*b*).

8. The equipment according to claim 1, wherein said gluing members (5) are each mounted on a supporting structure (4) via a cylinder (16) for the operation of said associated said gluing members (5) between the expended and folded positions.

9. The equipment according to claim 1, wherein the gluing-pad supporting structure (4) is in the general form of a vertical or substantially vertical central supporting axis, on which is articulated at least one extendable arm (17) connected to operating means (6), and the free end of which carries a gluing pad member (5), said operating means (6) extending and folding said extendable arm(s) (17) with respect to said central supporting axis (4).

10. The equipment according to claim 9, wherein said extendable arm(s) (17) cooperate with a slide (18) capable of sliding along the height of the central supporting axis (4), the translation movements of said slide (18) operating said extendable arm(s) (17) in the extension and folding directions.

11. The equipment according to claim 10, wherein said extendable arm(s) (17) are articulated at the lower end of the central supporting axis (4), the slide (18) cooperating with said extendable arm(s) (17) through an intermediate arm (19) having one end articulated on said slide (18) and the other end articulated on said associated extendable arm (17), at a point located between the two ends thereof.

12. The equipment according to claim 10, wherein the extendable arm(s) (17) are articulated at one of their ends on the slide (18) of the supporting axis (4), one or more intermediate operating arms (19) being articulated, on the one hand, at the lower end of the central supporting axis (4), and on the other hand, on one of the extendable arms (17), at an articulation point located between the two ends thereof.

13. The equipment according to claim 10, wherein the slide (18) is operated along the central supporting axis (4) by means of a control cylinder.

14. The equipment according to claim 11 wherein the slide (18) is operated along the central supporting axis (4) by means of a control cylinder.

15. The equipment according to claim 12, wherein the slide (18) is operated along the central supporting axis (4) by means of a control cylinder.

16. The equipment according to claim 9, wherein the slide (18) is operated along the central supporting axis (4) by means of a control cylinder.

17. The equipment according to claim 1, wherein the glue feeding means (7) comprise at least one tank (7*a*) connected to a circuit (7*b*) for supplying glue to at least one of the porous material blocks (5*b*), said supplying circuit (7*b*) comprising flow control means (7*c*).

* * * * *